US007810510B2

(12) United States Patent
Tranchant

(10) Patent No.: US 7,810,510 B2
(45) Date of Patent: Oct. 12, 2010

(54) PACKAGING AND APPLICATOR ASSEMBLY FOR MASCARA AND ITS USE IN APPLYING MASCARA

(75) Inventor: Jean-Francois Tranchant, Marigny-les-Usages (FR)

(73) Assignee: L V M H Recherche, Saint Jean de Braye (FR)

( * ) Notice: Subject to any disclaimer, the term of this patent is extended or adjusted under 35 U.S.C. 154(b) by 412 days.

(21) Appl. No.: 11/719,810

(22) PCT Filed: Nov. 25, 2005

(86) PCT No.: PCT/FR2005/002937

§ 371 (c)(1),
(2), (4) Date: Jun. 26, 2007

(87) PCT Pub. No.: WO2006/056699

PCT Pub. Date: Jun. 1, 2006

(65) Prior Publication Data

US 2009/0071498 A1 Mar. 19, 2009

(51) Int. Cl.
*A45D 40/26* (2006.01)
*A46B 11/00* (2006.01)

(52) U.S. Cl. ..... 132/218; 401/126; 401/129

(58) Field of Classification Search ..... 132/218, 132/317, 318; 401/122, 121, 126, 129, 130, 401/119, 128
See application file for complete search history.

(56) References Cited

U.S. PATENT DOCUMENTS 5,192,153 A * 3/1993 Gueret ..... 401/4
5,780,130 A * 7/1998 Hansen et al. ..... 428/35.7
6,158,912 A 12/2000 Miraglia et al.
6,279,780 B1 * 8/2001 Rousselet ..... 222/107
6,287,034 B1 * 9/2001 Miraglia et al. ..... 401/122
6,474,890 B1 * 11/2002 Gueret ..... 401/126
2003/0209566 A1 * 11/2003 Winckels ..... 222/212

FOREIGN PATENT DOCUMENTS

WO WO 2004/071870 A2 8/2004

OTHER PUBLICATIONS

French Preliminary Search Report FR 0412526; report dated Jul. 15, 2005.
International Search Report PCT/FR2005/002937; report dated Apr. 18, 2006.

* cited by examiner

*Primary Examiner*—Robyn Doan
(74) *Attorney, Agent, or Firm*—Miller, Matthias & Hull

(57) ABSTRACT

Package/applicator for mascara, comprising a receptacle of axis XX and a wall, defining an inside space, the top portion of the wall being stiffened, and the bottom portion of the wall being flexible and capable of being moved from an expanded position to a squeezed position, a closure for temporarily closing said receptacle; a head, that is mounted on a stem, that is secured to the closure and that is capable of being put into contact with mascara, in the closed position, such that the volume defined by the bottom portion represents 15% to 60% of the total volume defined by the wall Alternatively, the package/applicator is such that the major fraction of the head is facing the stiffened portion, perpendicularly relative to axis XX.

13 Claims, 1 Drawing Sheet

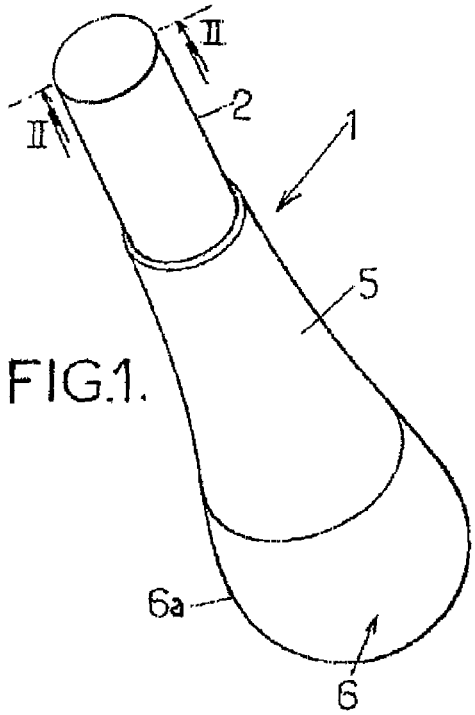
FIG.1.
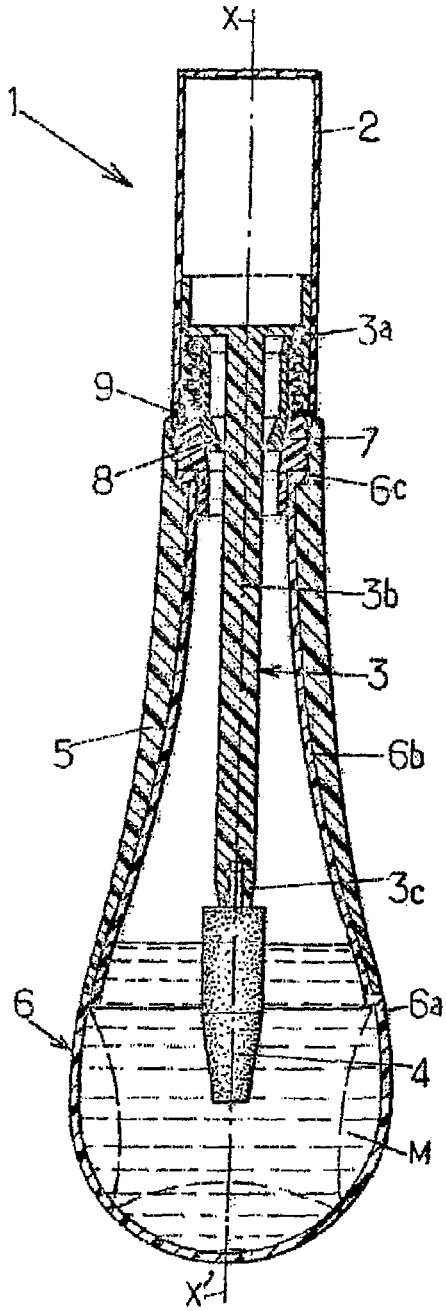
FIG.2.
FIG.3.
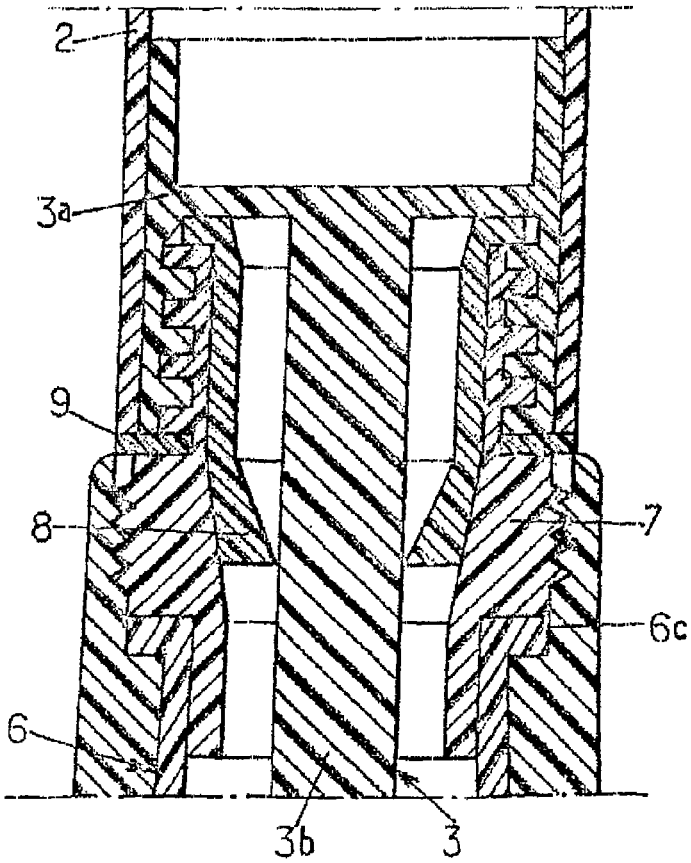

PACKAGING AND APPLICATOR ASSEMBLY FOR MASCARA AND ITS USE IN APPLYING MASCARA

CROSS-REFERENCE TO RELATED APPLICATION

This is the U.S. National Phase of International Application No. PCT/FR2005/02937 filed 25 Nov. 2005, claiming priority to French Patent No FR 04 12526, filed on 25 Nov. 2004

FIELD OF THE DISCLOSURE

The invention relates to a packaging and applicator assembly for mascara. The invention also relates to a method of using such an assembly for applying mascara, in particular for applying mascara to the eyelashes.

BACKGROUND OF THE DISCLOSURE

Packaging for applying mascara, in particular when said mascara is a liquid that is viscous to a greater or lesser extent, is tricky. Firstly, it is necessary to provide storage in a sealed or closed atmosphere in a packaging chamber, and secondly it is necessary to be able to guarantee that the stored mascara can be effectively dispensed when required by the user. This is all the more tricky since the current formulae for mascara are usually thixotropic, with relatively high viscosity. Consequently, it is advantageous to be able to knead said mascara thoroughly, so as to break its rest viscosity, and thus guarantee effective fluidizing thereof, and thus satisfactory loading of the brush with said mascara.

U.S. Pat. No. 6,158,912 describes a receptacle for a pasty cosmetic, said receptacle including a wall defining an inner chamber, with at least a portion of the wall being flexible. The receptacle includes a neck that gives access to the inside of said chamber. An applicator (or applicator head) is located in the receptacle and is attached to a cap that closes the receptacle at the neck. By pressing on the flexible wall of the receptacle, the user can deposit the cosmetic directly onto the applicator, which cosmetic would otherwise run the risk of remaining inaccessible because of the high viscosity of the pasty cosmetic.

Unfortunately, even if it enables such wastage of cosmetic to be avoided, that configuration presents numerous drawbacks when the cosmetic is a mascara that is generally thixotropic and viscous. Said applicator hinders the kneading action that is consequently much less effective. In addition, in this event, the applicator risks being damaged irreparably during said kneading.

In addition, most existing applicator devices for liquid mascara are generally of the type comprising a small flask and an applicator stem. Unfortunately, devices of that type also present the drawback of not making it easy for all of the cosmetic that is contained in said flask to be used up when only a small quantity remains after multiple uses. The viscosity of mascaras increases as the more volatile components of the liquid evaporate inevitably in contact with the atmosphere, and this, combined with the above-mentioned thixotropic character, can lead to a flow of mascara that is not sufficient for coating the applicator stem in satisfactory manner.

SUMMARY OF THE DISCLOSURE

The packaging and applicator assembly of the invention makes it possible to mitigate the above-described problem and to offer other, advantages. An object of the invention is to propose a packaging and applicator assembly for mascara that makes it possible to knead the mascara when said mascara is present in said assembly, so as to guarantee the most effective fluidization possible of said mascara. This is particularly appropriate when the mascara is thixotropic and viscous.

Thus, the assembly of the invention is a packaging and applicator assembly for mascara, said assembly comprising:

- a hollow receptacle for containing the mascara, said receptacle presenting a main axis of symmetry (X'X) and including a wall defining an inside space and an opening, at least a top portion of the wall being stiffened, and at least a bottom portion of the wall being flexible and capable of being moved from an expanded position to a squeezed position;
- closure means for closing said opening in removable manner; and
- an applicator head that is carried by a stem that is secured to the closure means, said applicator head being mounted in such a manner as to be capable of being put into contact with the mascara inside said hollow receptacle when the closure means are closed;

said assembly being characterized in that a major fraction of the applicator head is situated facing the stiff top portion of the wall in substantially perpendicular projection relative to said main axis (X'X) of said hollow receptacle.

In the invention, the applicator head is preferably not situated in the vicinity of the opening.

In the invention, the term "mascara" means a liquid that is viscous to a greater or lesser extent, and that is mainly for making-up the eyelashes. In conventional manner, such a mascara is generally thixotropic.

In the invention, the term "major fraction" means at least 50%, and preferably at least 60%, of the longest dimension of the applicator head. Said dimension is preferably in line with the stem.

In the invention, the term "stem" means a substantially elongate portion having axial symmetry. The stem is generally rectilinear, but it could also be curved.

In the invention, the term "axis of the stem" means the axis of the stem in the portion that is situated adjacent to the applicator head.

In the invention, the term "capable of being put into contact" means that contact can be made at least in part. In the invention, such contact is either spontaneous (i.e. the applicator head is in contact with the mascara when the kit is in the closed position), or it is not spontaneous (i.e. an action has to be exerted, e.g. a user must exert pressure, as described below, for said contact to be effective).

The invention also provides a packaging and applicator assembly for mascara, said assembly comprising:

- a hollow receptacle for containing the mascara, said receptacle presenting a main axis of symmetry (X'X) and including a wall defining an inside space and an opening, at least a top portion of the wall being stiffened, and at least a bottom portion of the wall being flexible and capable of being moved from an expanded position to a squeezed position;
- closure means for closing said opening in removable manner; and
- an applicator head that is carried by a stem that is secured to the closure means, said applicator head being mounted in such a manner as to be capable of being put into contact with the mascara inside said hollow receptacle when the closure means are closed;

said assembly being characterized in that the bottom portion of the wall defines a volume lying in the range 15% to 60%, and preferably in the range 20% to 40%, of the volume of the total space defined by the wall of said hollow receptacle.

By way of non-limiting example, the applicator head is a flocked tip, a felt, or preferably a brush. In general and preferably, said brush is such that it comprises bristles each having at least a portion that extends radially in a section that is perpendicular to the axis of the stem. Said brush preferably has a longitudinal axis that is rectilinear.

As set out above, the assembly of the invention makes it possible to fluidize thoroughly any mascara that is present in said assembly, given the thixotropic character of the mascara, by passing the flexible portion of the wall from the expanded position to the squeezed position, and doing this repeatedly, typically once, twice, or three times. It also makes it possible to load the applicator head with mascara with a view to applying it.

In an embodiment of the invention, the assembly further includes at least one neck that is secured to said wall, generally in the vicinity of its opening. In such circumstances, said assembly preferably further includes at least one wiper means that is usually secured to said neck, and that is generally mounted, at least in part, inside said neck.

Typically, said top portion of the wall of the receptacle is stiffened by the presence of at least one rigid material, i.e. the top portion of the wall is constituted, at least in part, by such a rigid material, or the top portion is covered by a part that is constituted, at least in part, by such a rigid material. Said rigid material is preferably selected from the group formed by polyethylenes such as low-density polyethylenes, high-density polyethylenes, and mixtures of polyethylenes of different densities; polyoxymethylenes; polypropylene; poly(vinyl chloride) or PVC; polyesters; polyamides; Nylon®; and mixtures of other plastics such as mixtures of polycarbonate and of polypropylene; and mixtures thereof. The rigid material is preferably made of polyoxymethylene.

The flexibility of said bottom portion of the wall of the receptacle is preferably obtained by the presence of at least one flexible material in its composition. Said flexible material is usually an elastomer or thermoplastic material such as silicone, fluorinated silicone, butyl rubber (or isobutylene-isoprene copolymer), nitrile rubber (or nitrile-butadiene copolymer or nitrile butadiene rubber (NBR)), VITON® (trademark filed by DuPont), an ethylene vinyl acetate copolymer (EVA), a polyether amide sequenced copolymer, a polyester elastomer, an ethylene and propylene rubber (EPM for copolymers or EPDM for terpolymers including dienes), a polyurethane, a styrene-ethylene-styrene (SES), a styrene-butadiene-styrene (SBS), a styrene-isoprene-styrene, a styrene/butylene-ethylene/styrene, an optionally-synthetic latex, and a rubber, and mixtures thereof.

The invention also provides a method of using an assembly of the invention for applying makeup, in particular for applying makeup to the eyelashes. Such a method is preferably such that the mascara is thixotropic.

The invention can be better understood, and other characteristics and advantages appear, on reading the following detailed description, given by way of non-limiting example, and with reference to FIGS. 1 to 3.

BRIEF DESCRIPTION OF THE DRAWINGS

FIG. 1 is a diagrammatic perspective view of a packaging and applicator assembly 1 of the invention.

FIG. 2 is a diagrammatic section view on section plane II-II of said assembly 1 of FIG. 1.

FIG. 3 is a diagrammatic view showing a fragment of FIG. 2 on a larger scale.

DETAILED DESCRIPTION OF THE DISCLOSURE

FIG. 1 is a diagrammatic perspective view of an assembly 1 of the invention. FIG. 1 is described in association with FIG. 2 which is a diagrammatic section view on section plane II-II of FIG. 1. A fragment of FIG. 2 is shown on a larger scale in FIG. 3 so as to make it easier to understand.

The assembly 1 of the invention comprises a wall 6 that forms a hollow receptacle and that defines an inside space or reservoir that is filled in part with mascara M. The wall 6 is constituted by a flexible wall 6 that is composed of three portions 6*a*, 6*b*, and 6*c*. In the embodiment shown in FIGS. 1 to 3 and described below, the assembly 1 also comprises a rigid part or ring 5 that covers the top portion 6*b* of the wall 6. Without going beyond the ambit of the present invention, it is also possible for the top portion of the wall itself to be rigid, while the bottom portion is flexible, the two portions being assembled together, e.g. by heat-sealing. Under such circumstances (not shown), the presence of the part 5 is no longer necessary.

Thus, in a perspective view as seen from the outside (see FIG. 1), it is possible to distinguish a rigid part 5 and a flexible bottom portion 6*a*. Covering the top portion 6*b* of the wall 6 with the rigid part 5 thus advantageously makes it possible to stiffen the top portion 6*b* of the wall 6. In addition, the rigid part 5 makes it easier to hold the packaging assembly (1) of the invention while kneading the mascara.

The assembly 1 also includes closure means (2, 3*a*) that are composed of a cap 2 and of a portion of a stem assembly 3 that is secured to said cap 2. Said stem assembly 3 is constituted by a "stem-carrier" top portion 3*a* that belongs to the closure means of the invention, and by a stem proper 3*b*, on the bottom portion 3*c* of which there is mounted the applicator head 4. As shown in FIG. 2, the stem 3*b* and the applicator head 4 are substantially rectilinear in line with each other. By way of example, the applicator head 4 is snap-fastened by force on the bottom portion 3*c* of the stem 3*b*.

The device 1 includes an opening in its top portion. A neck 7, generally made of rigid material, is mounted in the vicinity of said opening. The neck 7 and the rigid part 5 are assembled together by screw-fastening. The wall 6 is held by compressing the top portion 6*c* of the wall 6 against the rigid part 5 by screwing on the neck 7. A gasket 9, that is generally made of nitrile rubber, makes it possible to seal the assembly 1 once closed by the closure means (2, 3*a*). The stem-carrier 3*a* and the cap 2 are bonded together. Advantageously for the assembly 1 shown in FIGS. 2 and 3, the neck 7 is secured to wiper means 8 that act mechanically while the assembly 1 is being opened and the applicator head 4 is being removed from the assembly 1. In general, the wiper means 8 penetrate, at least in part, into the neck 7, as shown in FIG. 2.

Alternatively, and without going beyond the ambit of the present invention, the stem-carrier 3*a* need not come into contact with the gasket 9, but may be fastened higher up within the cap 2, e.g. by adhesive. Such an embodiment is not shown.

The stress that can be exerted on the flexible bottom portion 6*a* of the wall 6, generally by the user, is usually stress for passing it from an expanded position to a squeezed position. In the invention, and in particularly advantageous manner, the stress exerts no direct action on the applicator head 4. In the invention, and in particularly advantageous manner, it especially makes it possible to knead the mascara M so as to fluidize it.

The dashed lines in FIG. 2 indicate a position that is reached as a result of squeezing, i.e. a position in which pressure is applied to the flexible bottom portion 6*a* of the wall 6 in such a manner as to encourage fluidizing the mascara M. The flexible bottom portion 6*a* is suitable for being squeezed in different directions, both transversally relative to the main axis X'X of the receptacle, and longitudinally from the base of said receptacle. It should be noted that pressure on the flexible wall of the base of the receptacle makes it possible to raise the level of the mascara M.

The other position of the flexible bottom portion 6*a*, which is the position shown by continuous lines in FIG. 2, is an expanded position, as occupied at rest and by default when no squeezing is applied.

Thus, the invention presents two advantages. Firstly, the device of the invention makes it possible to reduce the viscosity of the mascara by kneading it, consequently making it easier to use, and secondly it makes it possible to coat the applicator head even when the quantity of mascara remaining in the receptacle is small and has become more viscous, which occurs after multiple uses.

A Method of Manufacture by Way of Example

The mascara packaging and applicator assembly of the example is substantially the assembly 1 shown in FIGS. 1 to 3. The parts 7 and 5 are made by turning, and are made of polyoxymethylene. They are generally assembled together by screw-fastening. The part 6 is made by embossing in a mold, with a join plane over its entire height, its ejection from the mold being performed by manual inflation. The volume of the reservoir lies in the range 5 milliliters (mL) to 15 mL, and preferably in the range 5 mL to 10 mL.

The invention claimed is:

1. A packaging and applicator assembly for applying mascara, said assembly comprising:

a hollow receptacle for containing the mascara, said receptacle presenting a main axis of symmetry and including a wall defining an inside space and an opening, at least a top portion of the wall being stiffened, and at least a bottom portion of the wall being flexible and capable of being moved from an expanded position to a squeezed position;

closure means for closing said opening in removable manner; and an applicator head that is carried by a stem that is secured to the closure means, said applicator head being mounted in such a manner as to be capable of being put into contact with the mascara inside said hollow receptacle when the closure means are closed;

wherein a majority of the applicator head is positioned across from the stiff top portion of the wall in a lateral direction substantially perpendicular to said main axis of the hollow receptacle; and wherein the bottom portion includes a flexible bottom opposite the opening and a flexible lateral wall, the entire bottom portion being adapted to be squeezed radially so as to knead the mascara.

2. The assembly according to claim 1, in which the bottom portion of the wall defines a volume lying in the range 15% to 60%, and preferably in the range 20% to 40%, of the volume of the total space defined by the wall of the hollow receptacle.

3. The assembly according to claim 1, further including at least one neck that is secured to said wall.

4. The assembly according to claim 3, further including at least one wiper means that is secured to said neck.

5. The assembly according to claim 1, in which said applicator head is a flocked tip, a felt, or a brush.

6. The assembly according to claim 5, in which said applicator head is a brush, said brush preferably having a longitudinal axis that is rectilinear.

7. The assembly according to claim 1, in which the top portion of the wall of the hollow receptacle is constituted, at least in part, by a rigid material.

8. The assembly according to claim 1, in which the top portion of the wall of the hollow receptacle is covered by a part that is constituted, at least in part, by a rigid material.

9. The assembly according to claim 7, in which the rigid material is selected from the group formed by polyethylenes such as low-density polyethylenes, high-density polyethylenes, and mixtures of polyethylenes of different densities; polyoxymethylenes; polypropylene; poly(vinyl chloride); polyesters; polyamides; Nylon®; and mixtures of other plastics such as mixtures of polycarbonate and of polypropylene; and mixtures thereof, the rigid material preferably being made of polyoxymethylene.

10. The assembly according to claim 1, in which the flexibility of the bottom portion of the wall of the hollow receptacle is obtained by the presence of at least one flexible material in its composition.

11. The assembly according to claim 10, in which said flexible material is an elastomer or thermoplastic material such as silicone, fluorinated silicone, butyl rubber, nitrile rubber, VITON®, an ethylene vinyl acetate copolymer (EVA), a polyether amide sequenced copolymer, a polyester elastomer, an ethylene and propylene rubber, a polyurethane, a styrene-ethylene-styrene (SES), a styrene-butadiene-styrene (SBS), a styrene-isoprene-styrene, a styrene/butylene-ethylene/styrene, an optionally-synthetic latex, and a rubber, and mixtures thereof.

12. Use of an assembly according to claim 1 for applying makeup, in particular for applying makeup to the eyelashes.

13. The use according to claim 12, in which the mascara is thixotropic.

* * * * *